United States Patent [19]

Merkel

[11] Patent Number: 4,967,430

[45] Date of Patent: Nov. 6, 1990

[54] METHOD OF MAKING UP WATER BEDS

[76] Inventor: Ronald F. Merkel, 2010 Yorktown Ct. South, League City, Tex. 77573

[21] Appl. No.: 514,505

[22] Filed: Apr. 25, 1990

[51] Int. Cl.[5] ..... A47G 9/02; A47C 27/08

[52] U.S. Cl. ..... 5/451; 5/498; 5/508; 24/72.5

[58] Field of Search ..... 5/451, 508, 542, 496, 5/498, 495, 482; 24/72.5

[56] References Cited

U.S. PATENT DOCUMENTS 4,506,398 3/1985 Hruban ..... 5/498

4,716,608 1/1988 Whitfield ..... 5/498

*Primary Examiner*—Alexander Grosz

*Attorney, Agent, or Firm*—Neal J. Mosely

[57] ABSTRACT

A method of making up water beds is disclosed wherein a standard size bottom sheet is first placed across the mattress and overhangs the sides of the water bed. A rod or pole having a length, e.g., six feet, slightly less than the length of the mattress is then placed over the sheet at one edge of the bed and then pressed between the mattress and the water bed frame to draw the sheet downward between the mattress and the frame. The rod or pole is pressed downward to the bottom of the water bed frame where the sidewise pressure of the mattress causes the mattress to overlie the pole and edge of the sheet to positively hold the edge of the sheet in place. A second rod or pole of like size is then placed over the sheet at the opposite edge of the bed and pressed between the mattress and the water bed frame to draw the sheet downward between the mattress and the frame. This second rod or pole is also pressed downward to the bottom of the water bed frame where the sidewise pressure of the mattress causes the mattress to overlie the pole and edge of the sheet to positively hold the edge of the sheet in place. While the rods or poles at each edge of the water bed are effective to hold the edges of the sheet in place, if desired, one may similarly use rods or poles at the head and foot ends of the bed to hold the top and bottom of the sheet in place.

12 Claims, 2 Drawing Sheets

METHOD OF MAKING UP WATER BEDS

BACKGROUND OF THE INVENTION

1. Field of the Invention

This invention relates generally to water beds and more particularly to a method and apparatus for making up water beds.

2. Brief Description of the Prior Art

The use and operational positioning and retention of bedding and bed sheets, both on conventional mattresses and water bed mattresses, presents the type of annoying problems that remain unsolved satisfactorily. Prior efforts to solve the problems with relation to the older, conventional mattresses may be seen in U.S. Pat. Nos. 739,682; 1,297,551; 2,507,091; 3,606,622; and 4,100,632.

With the fairly recent advent of the water bed, there have arisen bedding problems of even greater complexity. Those skilled in the art will, of course, appreciate that the plastic or flexible character of a fluid-filled mattress vitiates some of the earlier devices that might have proved relatively effective with the more rigid conventional mattress. Problems representative of the type encountered with water beds are described in Katzakian U.S. Pat. No. 4,228,555; Hruban U.S. Pat. No. 4,506,398; Whitfield U.S. Pat. No. 4,716,608; and Lynn U.S. Pat. No. 4,809,377.

The complexity and magnitude of the problems encountered with water beds is perhaps best appreciated from an examinatin of Katzakian U.S. Pat. No. 4,228,555. That reference teaches a complicated folding frame structure which is separate and apart from the water bed. A pad which is designed to be positioned between the occupant and the fluid-filled bladder is connected to the frame with marginal edge hook and loop type fasteners or the like. The top sheet has hemmed pockets on three sides into which the pivotal members of the frame structure are inserted and that sheet, which is double length, is folded back toward the head of the bed. The entire frame thus attired is positioned over the bladder and rests on the bed frame.

Despite the sophistication and complexity of the described patented bed sheet frame, the shortcomings attendant the use of that structure are apparent. Thus, for example, the "making" of the bed is complicated and difficult. With a frame structure most likely made of metal rods, there exists the danger of damage to the fluid bladder. Similarly, there exists the danger of injury to the occupant who could roll over against the frame structure. The sheets, and particularly the top sheet, are of such unusual form and dimensions that special laundering processes are probably required. Finally, there is the obvious expense of the frame structure and highly specialized sheets.

The next development in attempting to solve the problems of water bed coverings is shown in Hruban U.S. Pat. No. 4,506,398. Since a waterbed mattress is a flexible, fluid-filled vessel, that patent concludes that some earlier devices, which are relatively effective with more rigid, conventional mattresses, are ineffective on waterbeds. To overcome this stated deficiency, the patent discloses a generally rectangular waterbed sheet including hemmed pockets along its sides but not its corners. Each pocket is adapted to telescopically receive a rigid member in the form of a rod that in use is gripped between the walls of the bedframe and bladder-mattress to prevent movement of the sheet. Thus, the sheet must be particularly dimensioned to properly drape over the mattress to ensure that the rods are gripped at the desired point between the mattress and the bedframe walls.

A more recent, but still complicated, attempt to solve the problem of water bed coverings, is disclosed in Whitfield U.S. Pat. No. 4,716,608. That device employed a releasable mattress cover holder, including a rectangular anchoring device positioned below the sleeping surface of the mattress. The invention also included fastening members for connecting the anchoring device to a mattress cover.

Most recently Lynn U.S. Pat. No. 4,809,377 sought to provide a simple solution in the way of a sheet retainer for waterbeds.

There thus exists a need for a method and apparatus for making up water beds that is simple. The present invention is distinguished from this and other prior art by its method and apparatus of making up water beds wherein a standard size bottom sheet is first placed across the mattress and overhangs the sides of the water bed. A rod or pole having a length, e.g., six feet, slightly less than the length of the mattress is then placed over the sheet at one edge of the bed and then pressed between the mattress and the water bed frame to draw the sheet downward between the mattress and the frame. The rod or pole is pressed downward to the bottom of the water bed frame where the sidewise pressure of the mattress causes the mattress to overlie the pole and edge of the sheet to positively hold the edge of the sheet in place. A second rod or pole of like size is then placed over the sheet at the opposite edge of the bed and pressed between the mattress and the water bed frame to draw the sheet downward between the mattress and the frame. This second rod or pole is also pressed downward to the bottom of the water bed frame where the sidewise pressure of the mattress causes the mattress to overlie the pole and edge of the sheet to positively hold the edge of the sheet in place. While the rods or poles at each edge of the water bed are effective to hold the edges of the sheet in place, if desired, one may similarly use rods or poles at the head and foot ends of the bed to hold the top and bottom of the sheet in place.

SUMMARY OF THE INVENTION

It is therefore an object of the present invention to provide a new and improved method and apparatus for making up water beds.

It is another object of this invention to provide a new and improved method and apparatus for making up water beds using standard size bottom sheets for the bed.

It is another object of this invention to provide a new and improved method and apparatus for making up water beds using standard size bottom sheets for the bed which does not require the use of specially modified bed sheets or special apparatus installed in the bed.

It is another object of this invention to provide a new and improved method and apparatus for making up water beds using standard size bottom sheets for the bed wherein poles or rods are placed over the sheet at each edge of the water bed and pressed downward between the mattress and the wall of the mattress frame substantially to the bottom of the frame.

Other objects of the invention will become apparent from time to time throughout the specification and claims as hereinafter related.

These and other objects of the invention are accomplished by a novel method and apparatus for making up water beds as disclosed wherein a standard size bottom sheet is first placed across the mattress and overhangs the sides of the water bed. A rod or pole having a length, e.g., six feet, slightly less than the length of the mattress is then placed over the sheet at one edge of the bed and then pressed between the mattress and the water bed frame to draw the sheet downward between the mattress and the frame. The rod or pole is pressed downward to the bottom of the water bed frame where the sidewise pressure of the mattress causes the mattress to overlie the pole and edge of the sheet to positively hold the edge of the sheet in place. A second rod or pole of like size is then placed over the sheet at the opposite edge of the bed and pressed between the mattress and the water bed frame to draw the sheet downward between the mattress and the frame. This second rod or pole is also pressed downward to the bottom of the water bed frame where the sidewise pressure of the mattress causes the mattress to overlie the pole and edge of the sheet to positively hold the edge of the sheet in place. While the rods or poles at each edge of the water bed are effective to hold the edges of the sheet in place, if desired, one may similarly use rods or poles at the head and foot ends of the bed to hold the top and bottom of the sheet in place.

DESCRIPTION OF THE PREFERRED EMBODIMENT

Figure 1:
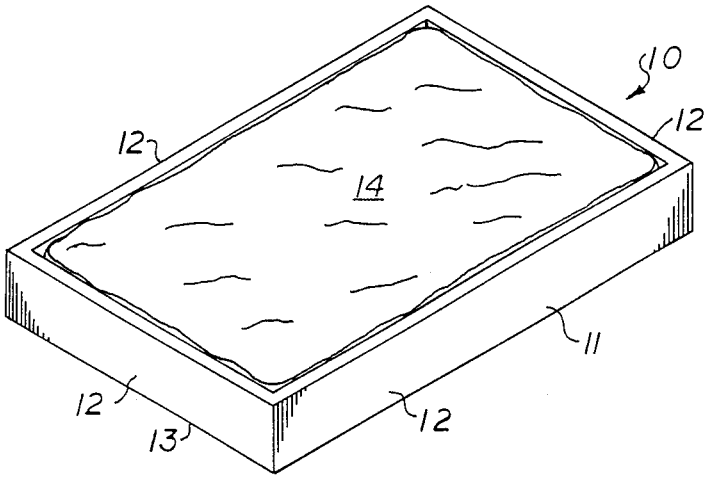
FIG. 1 is an isometric view of a conventional water bed with which the present invention is illustrated.
Figure 2:
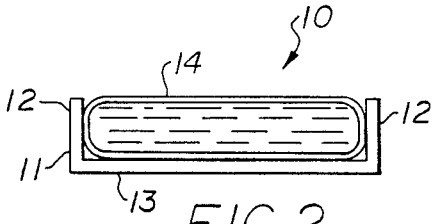
FIG. 2 is a sectional view of the water bed shown in FIG. 1.

Referring to the drawings by numerals of reference, and more particularly to FIG. 1, there is shown a conventional water bed 10 comprising a mattress frame 11 having side walls 12 and a bottom wall 13. A water mattress 14 is positioned inside frame 11 and filled with water so that the mattress is confined by the walls of the frame. As discussed above, this conventional water bed is quite difficult to make up. It is difficult to insert the edges of a standard sheet into the space between the water mattress and bed frame and the sheet usually pulls out when the bed is used. This conventional water bed, as shown in FIGS. 1 and 2, will be used to illustrate the invention.

Figure 3:
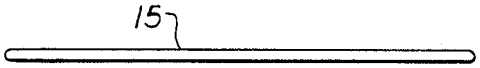
FIG. 3 is a view in elevation of a pole or rod used in carrying out the method of this invention.

This invention uses a plurality of rods or poles 15 (FIG. 3) to make up a water bed and secure the bed sheet in place. There are at least two of the rods or poles 15 used, one on each side of the bed, and optionally one on the top and bottom of the bed. The rods or poles are of a length slightly less than the length of the water bed mattress 14 for use on the sides of the bed and slightly less than the width of the bed for use on the ends of the bed. Rods or poles which are about six feet long are satisfactory for beds of queen or king size for both the sides and ends while slightly shorter rods or poles would be used for the ends of regular double beds. The rods or poles may be of any suitable material, e.g. wood, plastic, etc., and may be solid or hollow according to the weight and strength of the material used.

Figure 4:
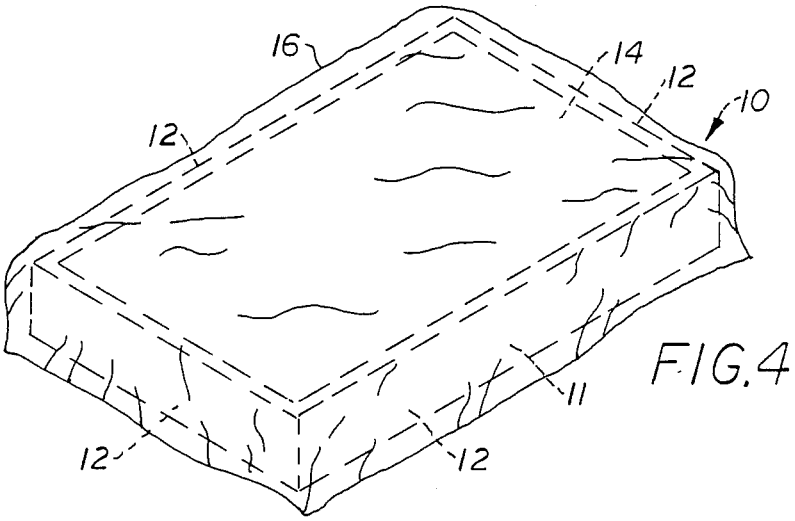
FIG. 4 is an isometric view of the water bed of FIG. 1 with a standard bed sheet placed across the bed.
Figure 5:
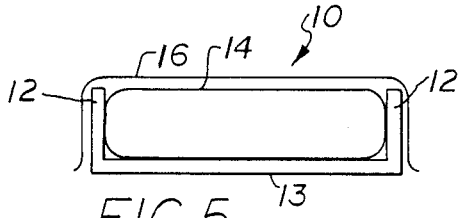
FIG. 5 is a sectional view of the water bed shown in FIG. 4 with a sheet placed across the bed.

In FIGS. 4 and 5, there is shown the first step of the method of this invention for making up water beds 10 in accordance with this invention. A bed sheet 16 of standard size for the size of bed being made up is placed across the top of the bed and the edges of the sheet draped over the edges and ends of the bed. The bed sheet 16 overlies the top of the water-filled mattress 14.

Figure 6:
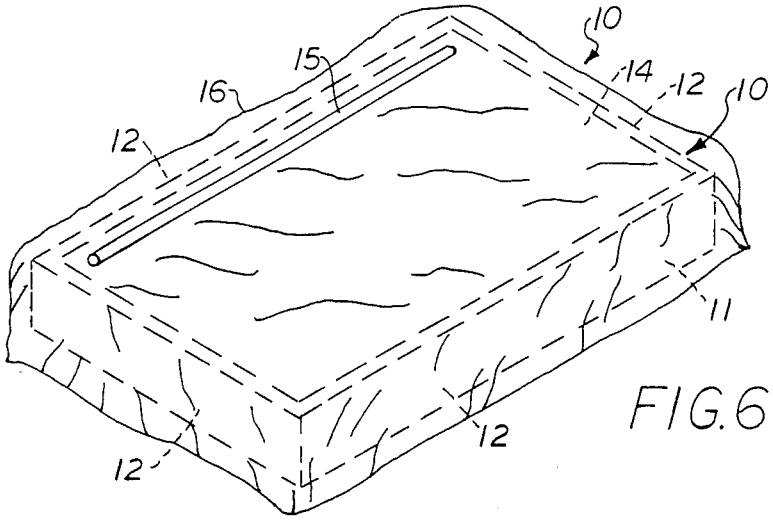
FIG. 6 is an isometric view of the water bed shown in FIG. 4 with a sheet placed across the bed and a rod or pole placed along one edge of the bed on top of the sheet in preparation for making up the bed.
Figure 7:
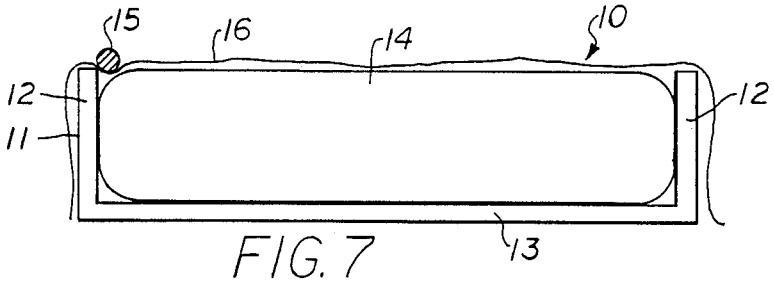
FIG. 7 is a sectional view of the water bed shown in FIG. 6 with a sheet placed across the bed and a pole placed along one edge of the bed on top of the sheet
Figure 8:
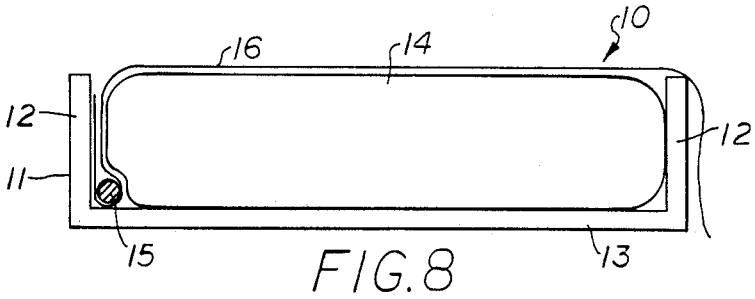
FIG. 8 is a sectional view of the water bed shown in FIG. 6 with a sheet placed across the bed and a pole placed along one edge of the bed and the pole forced to a position where the mattress overlies the pole and edge of the sheet to positively hold the edge of the sheet in place.

Next, one of the rods or poles 15 is placed on top of bed sheet 16 along one edge of the bed as shown in FIGS. 6 and 7. The rod or pole is then forced to the bottom of the bed frame 11 (FIG. 8) pulling the edge of sheet 16 downward as indicated When rod or pole 15 is pushed to the bottom 13 of mattress frame 11, sheet 16 is pulled tightly to the bottom of the space between the mattress 14 and wall 12 of frame 11 with the outer edge portion of sheet 16 tucked between the portion of the sheet tightened over the mattress and wall 12 of mattress frame 11.

Figure 9:
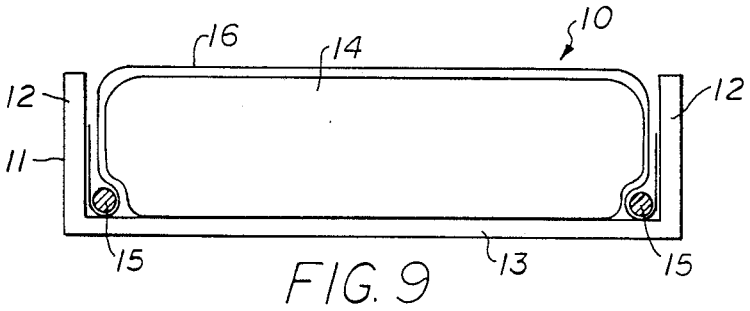
FIG. 9 is a sectional view of the water bed similar to FIG. 8 with a second pole positioned to secure the other side of the bed sheet in place.

Next, another one of the rods or poles 15 is placed on top of bed sheet 16 along the opposite edge of the bed. The rod or pole is then forced to the bottom of the bed frame 11 (FIG. 9) pulling the other edge of sheet 16 downward as indicated. When rod or pole 15 is pushed to the bottom 13 of the other side of mattress frame 11, sheet 16 is pulled tightly to the bottom of the space between the mattress 14 and wall 12 of frame 11 with the outer edge portion of sheet 16 tucked between the portion of the sheet tightened over the mattress and wall 12 of mattress frame 11 (FIG. 9). In this position, both sides of sheet 16 are tightly tucked in place. The tendency of mattress 14 to spread, under weight of water in the mattress or under the weight of someone on the bed, against the walls 12 or mattress frame 11 forces the mattress to spread over the rods or poles on each side of the bed and over lie the rods or poles and the portion of the sheet held by them thus positively holding the edges of the sheet in place.

Next, the top and bottom ends of the sheet may be forced into place neatly to complete making up the bed. If desired, rods or poles may be inserted at the top and bottom ends of the bed to secure the top and bottom ends of the sheet in place.

While this invention has been shown fully and completely with special emphasis on certain preferred embodiments, it should be understood that within the scope of the appended claims the invention may be practiced otherwise than as specifically described herein.

I claim:

1. A method of making up water beds comprising;

providing a water bed comprising a bed frame having side and end walls and a bottom wall and a water-filled mattress supported therein, providing a conventional bed sheet of standard size for the size of bed used, providing a plurality of rods or poles of a length slightly shorter than the length of the bed, spreading said sheet over said water-filled mattress and bed frame with the edges of the sheet hanging over the walls of the bed frame, placing one of said rods or poles over said sheet along the edge of one side of the bed along the line where the mattress presses against the bed frame, pressing said one rod or pole into the space between the edge of the mattress and the wall of the mattress frame to draw the edge of the sheet downward to be secured by sidewise pressure of the mattress against and overlying said one pole, the edge of said sheet being secured between the pole and mattress frame, placing another one of said rods or poles over said sheet along the edge of the other side of the bed along the line where the mattress presses against the bed frame, pressing said another rod or pole into the space between the edge of the mattress and the wall of the mattress frame to draw the edge of the sheet downward to be secured by sidewise pressure of the mattress against and overlying said another pole, the edge of said sheet being secured between the pole and mattress frame, and tucking the top and bottom ends of said sheet into the space between the top and bottom ends of said mattress and mattress frame.

2. A method of making up water beds according to claim 1 in which said rods or poles on each side of the bed are pressed to draw the respective edges of said sheet to the bottom of said mattress against the bottom wall of said mattress frame with the outermost edges of the sheet folded around the respective rods or poles and secured between the mattress and mattress frame.

3. A method of making up water beds according to claim 1 in which the step of tucking in the ends of said sheet includes the additional steps of placing one of said rods or poles over said sheet along the edge of the top end of the bed along the line where the mattress presses against the bed frame, pressing said last named or pole into the space between the top end of the mattress and the wall of the mattress frame to draw the edge of the sheet downward to be secured by sidewise pressure of the mattress against and overlying said pole, the edge of said sheet being secured between the pole and mattress frame, placing another one of said rods or poles over said sheet along the edge of the bottom end of the bed along the line where the mattress presses against the bed frame, and pressing said last named rod or pole into the space between the bottom end of the mattress and the wall of the mattress frame to draw the edge of the sheet downward to be secured by sidewise pressure of the mattress against and overlying said pole, the edge of said sheet being secured between the pole and mattress frame.

4. A method of making up water beds according to claim 1 in which the step of tucking in the ends of said sheet includes the additional steps of placing one of said rods or poles over said sheet along the edge of the top end of the bed along the line where the mattress presses against the bed frame, pressing said last named rod or pole into the space between the top end of the mattress and the wall of the mattress frame to draw the edge of the sheet downward to be secured by sidewise pressure of the mattress against and overlying said pole, the edge of said sheet being secured between the pole and mattress frame, placing another one of said rods or poles over said sheet along the edge of the bottom end of the bed along the line where the mattress presses against the bed frame, and pressing said last named rod or pole into the space between the bottom end of the mattress and the wall of the mattress frame to draw the edge of the sheet downward to be secured by sidewise pressure of the mattress against and overlying said pole, the edge of said sheet being secured between the pole and mattress frame, and wherein said rods or poles on each side and the top and bottom ends of the bed are pressed to draw the respective edges of said sheet to the bottom of said mattress against the bottom wall of said mattress frame with the outermost edges of the sheet folded around the respective rods or poles and secured between the mattress and mattress frame.

5. A method of making up water beds according to claim 1 in which said rods or poles are about six feet long.

6. A method of making up water beds according to claim 1 in which said rods or poles on each side of the bed are each about six feet long and are pressed to draw the respective edges of said sheet to the bottom of said mattress against the bottom wall of said mattress frame with the outermost edges of the sheet folded around the respective rods or poles and secured between the mattress and mattress frame.

7. A method of making up water beds according to claim 1 in which said rods or poles are each about six feet long, and in which the step of tucking in the ends of said sheet includes the additional steps of placing one of said rods or poles over said sheet along the edge of the top end of the bed along the line where the mattress presses against the bed frame, pressing said last named rod or pole into the space between the top end of the mattress and the wall of the mattress frame to draw the edge of the sheet downward to be secured by sidewise pressure of the mattress against and overlying said pole, the edge of said sheet being secured between the pole and mattress frame, placing another one of said rods or poles over said sheet along the edge of the bottom end of the bed along the line where the mattress presses against the bed frame, and pressing said last named rod or pole into the space between the bottom end of the mattress and the wall of the mattress frame to draw the edge of the sheet downward to be secured by sidewise pressure of the mattress against and overlying said pole, the edge of said sheet being secured between the pole and mattress frame.

8. A method of making up water beds according to claim 1 in which said rods or poles are each about six feet long, and in which the step of tucking in the ends of said sheet includes the additional steps of placing one of said rods or poles over said sheet along the edge of the top end of the bed along the line where the mattress presses against the bed frame, pressing said last named rod or pole into the space between the top end of the mattress and the wall of the mattress frame to draw the edge of the sheet downward to be secured by sidewise pressure of the mattress against and overlying said pole, the edge of said sheet being secured between the pole and mattress frame, placing another one of said rods or poles over said sheet along the edge of the bottom end of the bed along the line where the mattress presses against the bed frame, and pressing said last named rod or pole into the space between the bottom end of the mattress and the wall of the mattress frame to draw the edge of the sheet downward to be secured by sidewise pressure of the mattress against and overlying said pole, the edge of said sheet being secured between the pole and mattress frame, and wherein said rods or poles on each side and the top and bottom ends of the bed are pressed to draw the respective edges of said sheet to the bottom of said mattress against the bottom wall of said mattress frame with the outermost edges of the sheet folded around the respective rods or poles and secured between the mattress and mattress frame.

9. A water bed made up with a sheet secured thereon comprising;

a water bed comprising a bed frame having side and end walls and a bottom wall and a water-filled mattress supported therein, a conventional bedsheet of standard size for the size of bed used spread over the top of said mattress, a plurality of rods or poles of a length slightly shorter than the length of the bed placed over said sheet along opposite sides of the bed along the line where the mattress presses against the bed frame and pressed into the space between the edge of the mattress and the wall of the mattress frame to draw the respective edges of the sheet downward to be secured by sidewise pressure of the mattress against and overlying said poles, the edges of said sheet being secured between said rods or poles and said mattress frame, the top and bottom ends of said sheet being tucked into the space between the top and bottom ends of said mattress and mattress frame.

10. A water bed made up with a sheet secured thereon according to claim 9 in which said rods or poles on each side of the bed are pressed to draw the respective edges of said sheet to the bottom of said mattress against the bottom wall of said mattress frame with the outermost edges of the sheet folded around the respective rods or poles and secured between the mattress and mattress frame.

11. A water bed made up with a sheet secured thereon according to claim 9 in which a rod or pole is pressed into the space between the top end and bottom end, respectively, of the mattress and the wall of the mattress frame to draw the edge of the sheet downward to be secured by sidewise pressure of the mattress against and overlying said pole, the edge of said sheet being secured between the pole and mattress frame.

12. A water bed made up with a sheet secured thereon according to claim 9 in which said rods or poles on each side of the bed are pressed to draw the respective edges of said sheet to the bottom of said mattress against the bottom wall of said mattress frame with the outermost edges of the sheet folded around the respective rods or poles and secured between the mattress and mattress frame, a rod or pole is pressed into the space between the top end and bottom end, respectively, of the mattress and the wall of the mattress frame to draw t edge of the sheet downward to be secured by sidewise pressure of the mattress against and overlying said pole, the ed of said sheet being secured between the pole and mattress frame, and said rods or poles are each six feet long.

* * * * *